US005145168A

United States Patent [19]

Jonas et al.

[11] Patent Number: 5,145,168

[45] Date of Patent: Sep. 8, 1992

[54] COUNTER-CLOCKWISE SINGLE SHEET ROTATOR

[75] Inventors: Robert R. Jonas, Penfield; Robert F. Rubscha, Fairport, both of N.Y.

[73] Assignee: Xerox Corporation, Stamford, Conn.

[21] Appl. No.: 608,402

[22] Filed: Nov. 2, 1990

[51] Int. Cl.[5] ..... B65H 9/00

[52] U.S. Cl. ..... 271/234; 271/240; 271/229

[58] Field of Search ..... 271/234, 229, 239, 240, 271/273, 182, 184, 185, 250

[56] References Cited

U.S. PATENT DOCUMENTS

| | | | |
|---|---|---|---|
| 3,980,296 | 9/1976 | Craft et al. | 271/184 X |
| 4,653,744 | 3/1987 | Poehler et al. | 271/264 |
| 4,724,945 | 2/1988 | Martin | 198/412 |
| 4,733,857 | 3/1988 | Feldeisen et al. | 271/296 |
| 4,756,521 | 7/1988 | Martin | 271/225 |
| 4,830,356 | 5/1989 | Zohner | 271/226 |
| 4,877,234 | 10/1989 | Mandel | 271/225 |
| 4,927,133 | 5/1990 | Evans | 271/225 |
| 4,955,965 | 9/1990 | Mandel | 271/184 X |

FOREIGN PATENT DOCUMENTS

| | | | |
|---|---|---|---|
| 60-258038 | 12/1985 | Japan | 271/85 |

*Primary Examiner*—David H. Bollinger
*Attorney, Agent, or Firm*—William A. Henry, II

[57] ABSTRACT

A pivot brake is used in conjunction with a ball-on-belt transport and dual registration edge guides to rotate and register the output of printers by 90° to satisfy on-line finishing requirements. As a sheet is fed into the rotation mechanism by the ball-on-belt transport, it encounters the pivot brake which retards its travel. The ball-on-belt transport continues to drive the sheet, thereby rotating it about the brake and into the registration edge guides.

11 Claims, 3 Drawing Sheets

COUNTER-CLOCKWISE SINGLE SHEET ROTATOR

The present invention relates to a device for handling copy sheets en transit, and more particularly, to an apparatus for rotating sheets counter clockwise 90° within their plane of travel.

Some current printing systems deliver their output in the long edge feed direction ("portrait" orientation). This may preclude on-line finishing since some on-line finishing requires the sheets to be short edge fed ("landscape" orientation). For example, in order to perform standard letter folds using a buckle folder, copy sheets must be fed to the folder short edge first. Since the output from most copiers and electronic printers is long edge first, some type of sheet turning mechanism is necessary if folding is to be done in an on-line, straight-line system.

Prior art sheet turners include, for example, U.S. Pat. No. 4,830,356 which discloses a passive pinwheel copy sheet rotator in the form of a disc that rotates copy sheets 90° or 180°. The disc has four quadrants and is used in conjunction with a ball-on-belt registration system. As a sheet comes into contact with a quadrant of the disc, the sheet is stopped and a non-contacting side of the sheet rotates due to the ball-on-belt registration transport. A sheet turning device is shown in U.S. Pat. No. 4,877,234 in which sheets are separately driven by two rolls. For sheet turning, one of the rolls is stopped while the other continues to drive and rotate the sheet. An angled conveyor for document packages is shown in U.S. Pat. No. 4,927,133. A post extends from the conveyor which contacts a package to force the package to rotate around the post 90°. In U.S. Pat. No. 4,756,521, an apparatus for turning flat articles includes a rotating device which steers the articles in a preselected direction. U.S. Pat. No. 4,724,945 discloses an apparatus for turning flat articles that includes a rotating device having first and second pairs of rollers which steer the articles in a preselected direction. U.S. Pat. No. 4,653,744 discloses a device for transferring flat objects between two stations at an obtuse angle. A transport mechanism is located at the narrowest side of the gap for transporting the objects and rotating them around the obtuse angel. A copier is disclosed in U.S. Pat. No. 4,733,857 where sheets exit the copier processing station in a horizontal plane, are turned 90° while still in the plane, are transported upwardly in a vertical plane, and deposited in sorter trays which extend toward the operator. The above-mentioned patents are incorporated herein by reference. While the above-mentioned sheet turning devices will rotate sheets sufficiently, some are bulky, some are cumbersome, some are costly and some suffer from unreliability.

The Xerox 4050® printer has the ability to deliver document output to the input of a third party finishing device. Flexibility is added to the printer by the use of a clockwise copy sheet rotation assembly that delivers copy sheets to an output tray or finishing device either long edge first or short edge first. The rotation assembly rotates the copy sheets in a clockwise direction due to the method pages are printed from the electronic subsystem, i.e., the top of the page of printed material on the copy sheet would end up as the trail edge after rotation.

Due to some third party finishing booklet making requirement of double stitching at the top of a set, e.g., Borg Corporation's Booklet Maker which stitches, folds and trims sets, copy sheets from the 4050® have to be delivered 180° from the above-mentioned methods. Further, with 14 inch copy sheet rotation capability as a customer requirement, the present methods are not usable for this purpose in their present form.

Accordingly, disclosed in accordance with the present invention is a low cost, highly reliable single sheet counter clockwise rotator system that includes a pivot brake used in conjunction with a ball-on-belt transport. The brake is a dynamic pivot point which allows the system to accommodate various media sizes and types. The brake is in the form of a ball or balls which in either case must be of sufficient mass to overcome the drive force of the ball-on-belt transport and cause the corner of the sheet to slow down and act as a pivot point. The rotator system includes stationary and rotary registration edges.

For a better understanding of the invention, reference is made to the following drawings and description.

Figure 1:
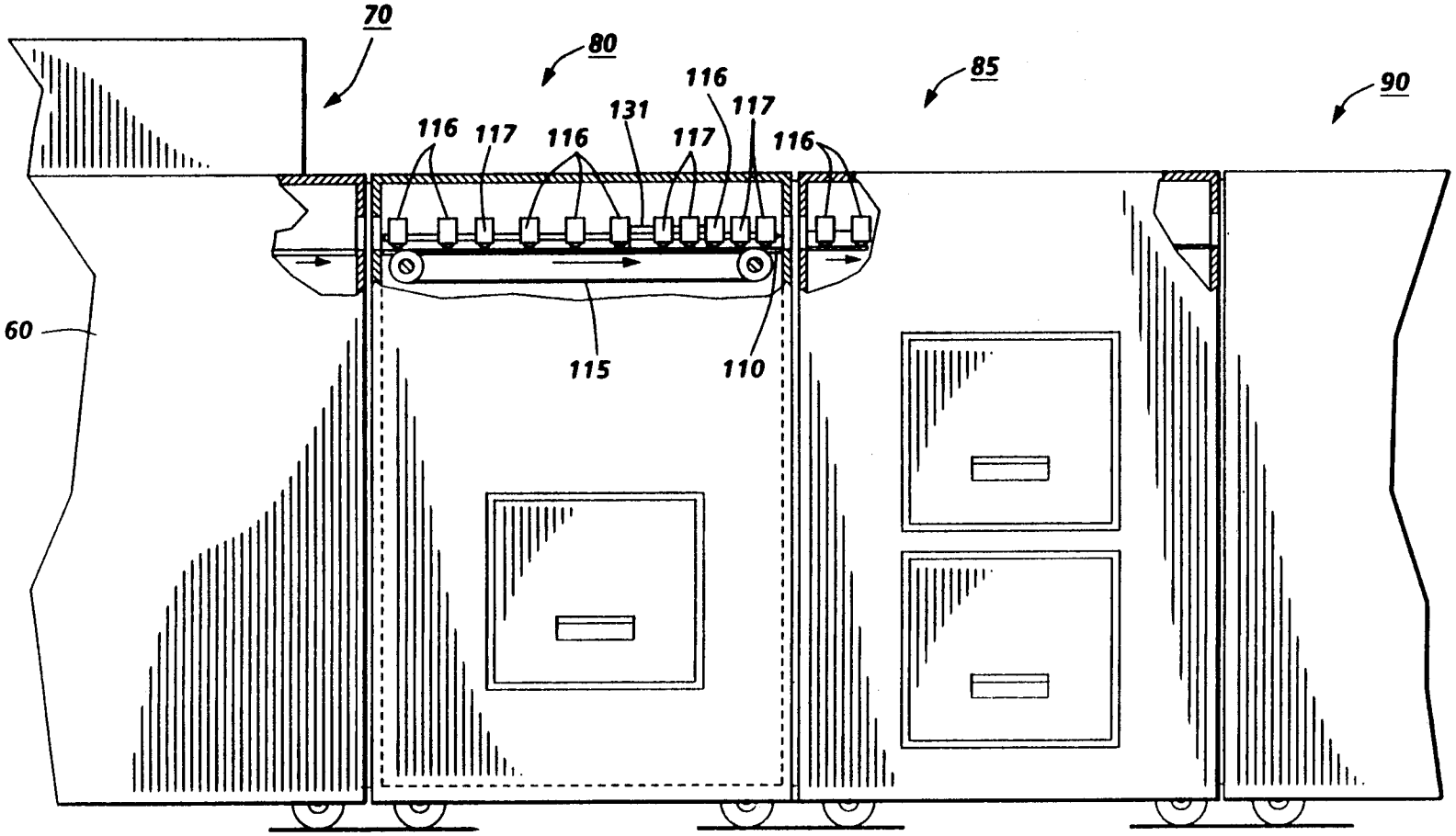
FIG. 1 is a front view of a conventional printer incorporating the copy sheet rotator of the present invention.

While the copy sheet rotator apparatus of the present invention will be described hereinafter in connection with the preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is had to the drawings. In the drawings, like reference numerals have been used throughout to designate identical elements.

Figure 2:
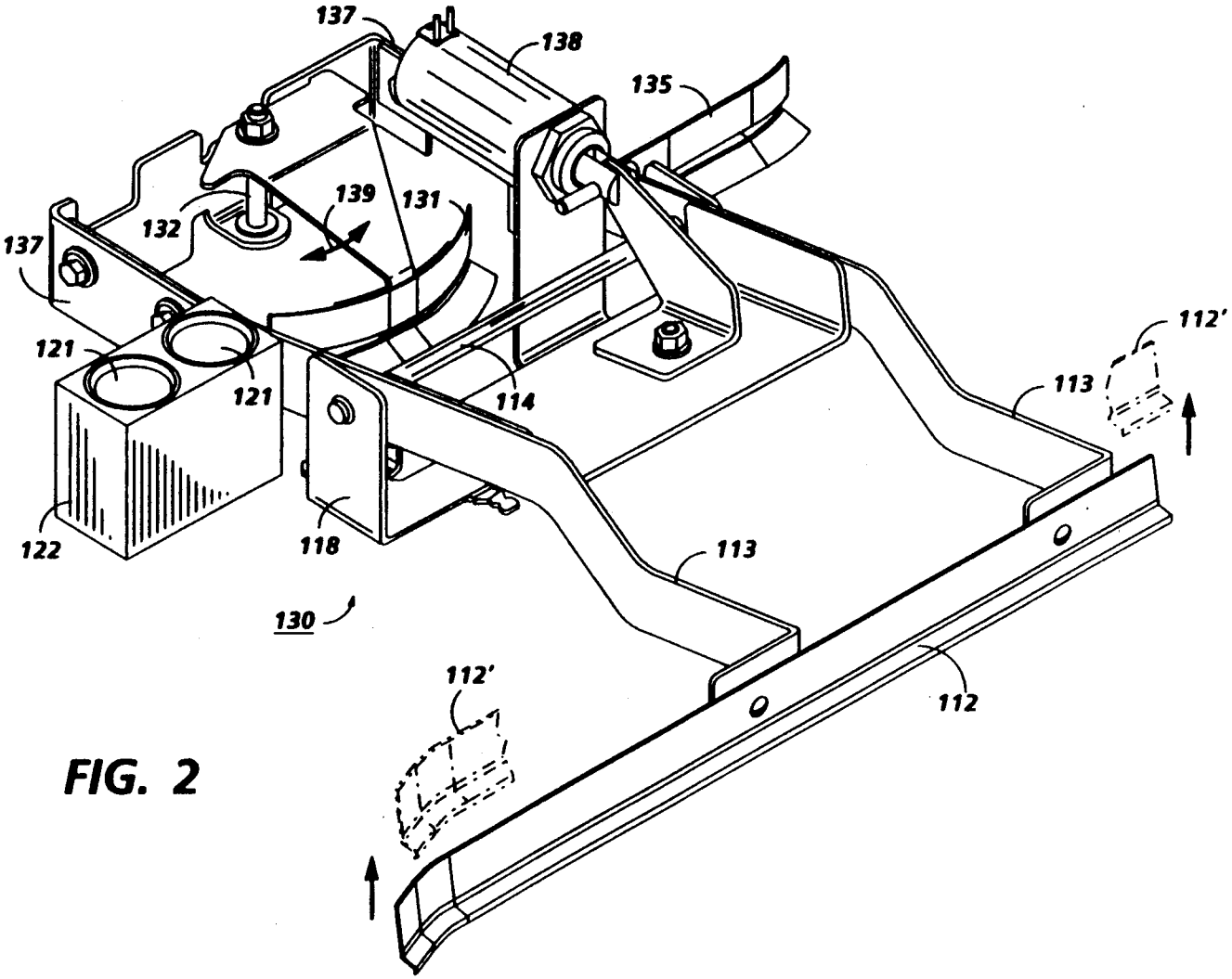
FIG. 2 is a partial, exploded isometric view of the sheet rotator in FIG. 1.
Figure 3:
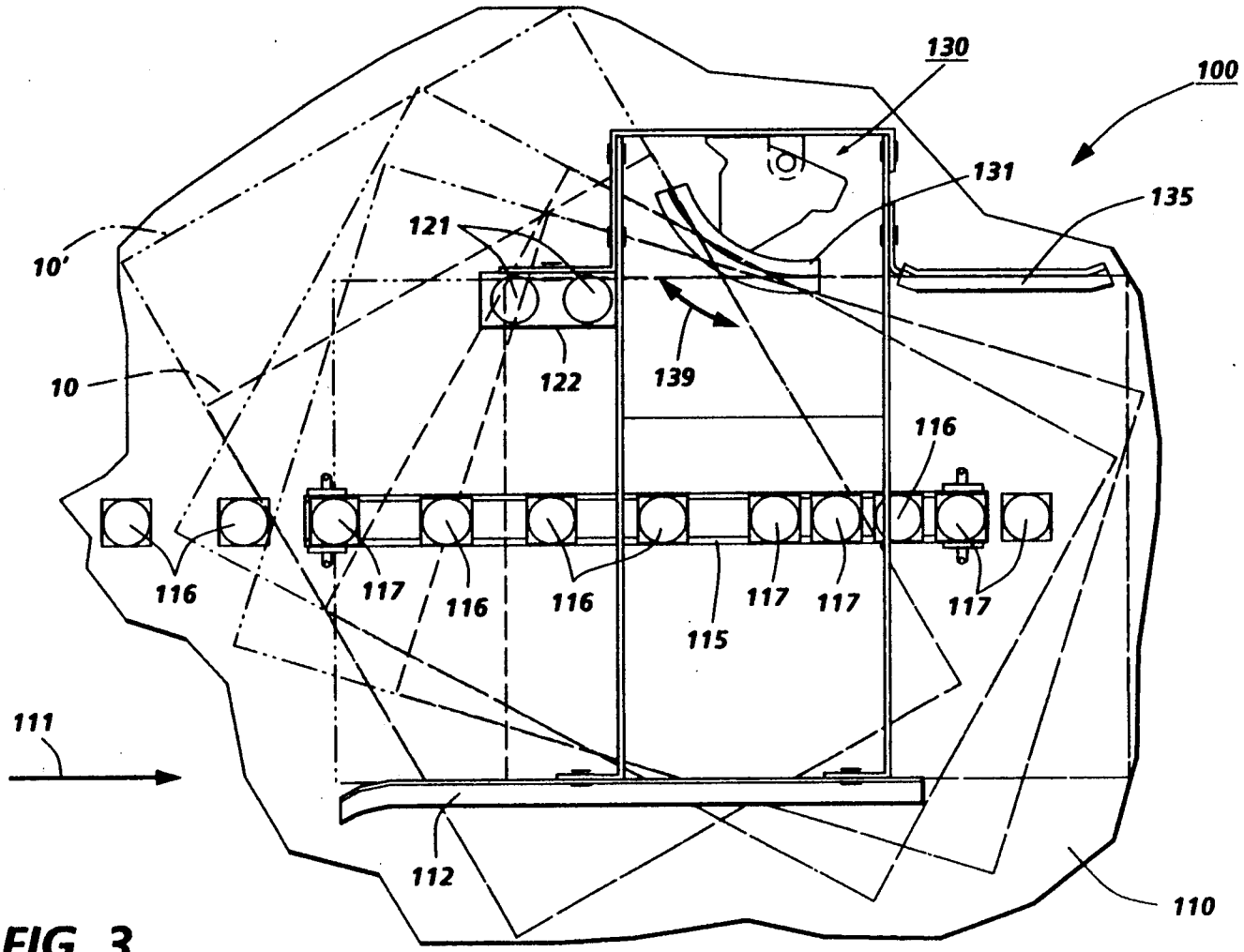
FIG. 3 is a schematic plan view incorporating a part of the sheet rotator of FIG. 2 showing phantom copy sheet positions during rotation.

Referring now particularly to FIGS. 1-3, there is illustrated an exemplary preferred copy sheet rotator system 100 in accordance with the present invention incorporated into a conventional printer 60, such as, the Xerox 4050®. The copy sheet rotator system 100 which rotates copy sheets counter clockwise comprises a solenoid controlled pivoting brake, a rotating edge guide, and two pivoting edge guides and is used in conjunction with a ball-on-belt conveyor to rotate copy sheets 10 through an angle of 90°. By rotating the copy sheet counter clockwise, the top of the printed page will exit the rotator system first. This direction of rotation enables the rotation of 14 inch copy sheets. Belt 115 of the ball-on-belt transport is positioned to drive copy sheets in the direction of arrow 111 and angled at approximately 1° with respect to registration edge 112 in order to drive copy sheets on baffle 110 toward the registration edge. Balls 116 and 117, respectively, are positioned above the belt to load copy sheets against the belts. Balls 116 are preferably made of steel and balls 117 are preferably plastic. The plastic balls function to present a minimum of friction to rotating copy sheets in order to not unnecessarily retard rotation of the copy sheets. As a copy sheet is fed into the copy sheet rotation section 80 of printer 60, it encounters balls 121 of copy sheet rotator system 100. Balls 121 are controlled by conventional controller 70 which actuates a conventional mechanism, for example, a solenoid 138 of FIG. 2 in order to place balls 121 against the sheet, for rotation purposes, by way of support housing 122 or maintain the balls in spaced relationship with respect to baffle 110 if sheet turning is not required.

As shown in FIG. 2, registration edge 112 is mounted for pivotal movement through rotation of shaft 114 by way of arms 113. Shaft 114 is supported by bracket 118 which also supports solenoid 138. Solenoid 138 is shown in its unactuated position in FIG. 2 which places registration edge 112 in a down position for contact by un-rotated copy sheets as they are fed through the printer. Dual edge guides 131 and 135 are connected to shaft 114 through supports 137 such that actuation of solenoid 138 causes registration edge guide 112 to pivot up to position 112' out of the path of copy sheets and dual registration edge guides 131 and 135 to pivot down into the path of copy sheets for counter clockwise rotation purposes.

A single registration edge 112 is used for un-rotated copy sheets and double registration edges 131 and 135 are used for rotated copy sheets. The un-rotated copy sheets are driven by the ball and belt drive transport with the outboard edge of the copy sheets against registration edge 112. The opposite happens when copy sheets are rotated, i.e., the double registration edges are pivoted out of the path of the copy sheets. As shown in FIG. 3, when copy sheet rotation is required, controller 70 actuates solenoid 138 (as shown in FIG. 2) which in turn forces housing 122 and thereby balls 121 against a copy sheet 10 of FIG. 3 which retards travel of the copy sheet. Here, the force of balls 121 against the copy sheet must be sufficient to overcome the drive force of belt 115 and cause the corner of the sheet under the balls to slow down and act as a pivot point. Any number of balls could be used as long as the weight of the balls overcome the drive force of the belt. Belt 115 continues to drive the copy sheet at about 1088 mm/sec, thus rotating the copy sheet about balls 121. Copy sheet rotation of 90° is accomplished when the copy sheet is driven against curved registration edge 131 which is mounted on shaft 132 and is on a conventional torsion spring pivot. This allows the registration edge to rotate in the direction of arrow 139 around with the copy sheet as it completes the rotation and to return to its original position once the copy sheet has moved beyond the guide. Rotation of edge guide 131 also minimizes damage to the copy sheet. Non-rotating registration edge 135 limits the amount of rotation of the copy sheet which ensures the delivery of the copy sheet to stacker 85 which in turn transports it to a third party finisher 90. The combination of the brake balls and the dual registration edges create a smooth transition for copy sheets from long edge feed to a short edge feed. The copy sheet rotator system 100 can switch between rotated and un-rotated copy sheets with only a single skipped pitch and will rotate a variety of different weights and copy sheet sizes.

In FIG. 3, rotation of two different copy sheet sizes is shown in phantom. In each depiction, rotation is counter clockwise. Copy sheet size $8\frac{1}{2}\times 11$ inches is shown as 10 and copy sheet size $8\frac{1}{2}\times 14$ inches is shown as 10', both being rotated about and along with rotatable registration edge guide 131. At the beginning of rotation, the top of the page image information on either copy sheet 10 or 10' is parallel to and outboard from registration edge guide 135, however, as rotation of a copy sheet continues this relationship gradually changes to a point where upon completion of rotation, the top of the page image information is orthogonal with respect to registration edge guide 135. Now, the copy sheet can be transported into finisher 90 to be double stitched at the top with the form in the desired position.

In recapitulation, an apparatus and method has been disclosed describing the use of a pivot brake and registration edge guides in conjunction with a ball-on-belt transport to rotate the output sheets of printers by 90° to satisfy on-line finishing requirements. When rotation is required, as a sheet is fed into the mechanism, it encounters the pivot brake which retards its travel. The ball-on-belt continues to drive the sheet about a rotating edge guide, rotating it 90° about the brake.

While the invention has been particularly shown and described with reference to preferred embodiments thereof, it will be understood by those skilled in the art that various changes in form and details may be made therein without departing from the spirit and scope of the invention.

What is claimed is:

1. A device for rotating sheets counter clockwise while they are en transit within a predetermined plane, comprising:

sheet transport drive means for transporting a sheet in a predetermined direction within said predetermined plane;

pivoting drag brake means for selectively retarding transport of the sheet while simultaneously allowing the sheets to rotate counter clockwise about said brake means while being driven by said sheet transport drive means;

pivotally supported dual positioning registration means for registering the sheet thereagainst, said dual positioning registration means including first, second and third registration edges; and means for pivoting said dual positioning registration means depending on whether the sheet is to be rotated or not rotated, said dual positioning registration means being adapted when pivoted by said means for pivoting into a first position to register the sheet against said first registration edge thereof without rotation and when pivoted into a second position by said means for pivoting to register the sheet with said second and third registration edges, respectively, while the sheet is held by said drag brake means and driven by said drive means.

2. The device of claim 1 wherein said second of said registration edges of said dual positioning registration means is rotatable and is rotated by movement of the sheet when said dual positioning registration means is in said second position.

3. A device for rotating sheets 90° counter clockwise while they are en transit within a predetermined plane, comprising:

sheet transport drive means for transporting a sheet in a predetermined direction within said predetermined plane;

pivoting drag brake means for retarding transport of the sheet while simultaneously allowing the sheet to rotate counter clockwise about said drag brake means while being driven by said sheet transport drive means;

dual positioning registration means for registering the sheet thereagainst, said dual positioning registration means being adapted when in a first position to register the sheet against a first registration edge thereof and when in a second position to register the sheet against a second registration edge thereof;

solenoid means for for simultaneously pivoting said drag brake means into contact with the sheet and said dual positioning registration means into said second position; and controller means for selectively actuating said solenoid means when 90° rotation of sheets is required, in order to position said dual positioning registration means into said second position.

4. The device of claim 3, wherein said second registration edge is opposite to said first registration edge with respect to the direction in which the sheet is transported by said sheet transport drive means.

5. The device of claim 4, including a third registration edge for registering the sheet when said dual positioning registration means is in said second position.

6. The device of claim 5, wherein said third registration edge is coextensive with a portion of said second registration edge when said dual positioning registration means is in said second position and the sheet has been rotated 90°.

7. A method for rotating sheets 90° , comprising the steps of:

(a) transporting the sheets in a predetermined direction;

(b) clamping the sheets at a selected corner;

(c) providing dual positioning registration means for registering the sheet thereagainst, said dual positioning registration means being adapted when in a first position to register the sheet against a first registration edge thereof and when in a second position to register the sheet against a second registration edge thereof;

(d) rotating the sheets 90° about the selected corner while simultaneously rotating said second registration edge of said dual position registration means by continuing step (a); and then (e) releasing the sheet from the clamping in step (b).

8. A device for rotating sheets counter clockwise while they are en transit within a predetermined plane, comprising:

sheet transport drive means for transporting a sheet in a predetermined direction within said predetermined plane;

pivoting drag brake means for selectively retarding transport of the sheet while simultaneously allowing the sheet to rotate counter clockwise about said brake means while being driven by said sheet transport drive means;

pivotally supported dual positioning registration means for registering the sheet thereagainst, and wherein said dual positioning registration means includes first, second and third registration edges for registering the sheet, said first registration edge being adapted to register a sheet that is not being rotated by said pivoting drag brake in conjunction with said sheet transport drive means and said second and third registration edges being adapted to register a sheet that is being rotated;

means connected to both said drag brake means and said dual positioning registration means for simultaneously pivoting said drag brake means into contact with the sheet and said second registration edge of said dual positioning registration means into contact with the sheet in order to rotate the sheet; and controller means for selectively actuating said means for simultaneously pivoting when 90° rotation of sheets is required.

9. The device of claim 8, wherein said third registration edge is coextensive with a portion of said second registration edge when the sheet has been rotated 90°.

10. The device of claim 8, wherein said means for simultaneously pivoting said drag brake means and said dual positioning registration means is a solenoid means connected to said pivoting brake means and said pivotally supported dual positioning registration means.

11. The device of claim 10, including control means for actuating said solenoid means when rotation of a sheet is required, whereby said solenoid means rotates said pivoting drag brake means into position to retard transport of the sheet while simultaneously allowing the sheet to rotate counter clockwise about said brake means while being driven by said sheet transport drive means while simultaneously pivoting said dual positioning registration means into position to register the rotated sheet.

* * * * *